US008660773B2

(12) United States Patent
Nakada

(10) Patent No.: US 8,660,773 B2
(45) Date of Patent: Feb. 25, 2014

(54) CONTROL DEVICE FOR INTERNAL COMBUSTION ENGINE WHICH OPERATES A THROTTLE CORRESPONDING TO A CONTROLLED VARIABLE

(75) Inventor: Hayato Nakada, Minamitsuru-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 199 days.

(21) Appl. No.: 13/129,266

(22) PCT Filed: Feb. 17, 2009

(86) PCT No.: PCT/JP2009/052634

§ 371 (c)(1),
(2), (4) Date: May 13, 2011

(87) PCT Pub. No.: WO2010/095209

PCT Pub. Date: Aug. 26, 2010

(65) Prior Publication Data

US 2011/0307162 A1 Dec. 15, 2011

(51) Int. Cl.
*F02D 41/30* (2006.01)

(52) U.S. Cl.
USPC ..... 701/104; 123/399; 123/478

(58) Field of Classification Search
USPC ..... 123/90.15, 399, 403, 406.46, 436, 478, 123/480, 488, 681; 701/102–104, 106, 110, 701/114, 115; 73/114.25, 114.31–114.33, 73/118.2
See application file for complete search history.

(56) References Cited

U.S. PATENT DOCUMENTS 6,363,316 B1 * 3/2002 Soliman et al. ..... 701/104
6,460,409 B1 * 10/2002 Soliman et al. ..... 73/114.72
6,626,144 B1 * 9/2003 Kanamaru ..... 123/399
6,662,640 B2 * 12/2003 Yagi ..... 73/114.34
6,718,822 B2 * 4/2004 Soliman et al. ..... 73/114.32

(Continued)

FOREIGN PATENT DOCUMENTS

JP A-2002-201998 7/2002
JP A-2003-120404 4/2003

(Continued)

OTHER PUBLICATIONS

International Search Report mailed Apr. 28, 2009 issued in International Patent Application No. PCT/JP2009/052634 (with translation).

*Primary Examiner* — Stephen K Cronin
*Assistant Examiner* — John Zaleskas
(74) *Attorney, Agent, or Firm* — Oliff PLC

(57) ABSTRACT

A delay time is provided in a calculation process until an instructed throttle opening is outputted after a required cylinder inside air filling efficiency is inputted. When calculation timing of a fuel injection quantity comes, an actual cylinder inside air filling efficiency which is achieved in a time ahead by the delay time from the present time is estimated by using an air response model. When a read-ahead time from the present time to closing timing of an intake valve exceeds the delay time, a change amount of the actual cylinder inside air filling efficiency which occurs by the time the read-ahead time elapses from a time point when the delay time elapses is estimated by using an air response model with a deviation between an estimated actual cylinder inside air filling efficiency after the delay time and a target cylinder inside air filling efficiency as a step input value.

7 Claims, 3 Drawing Sheets

(56) References Cited

U.S. PATENT DOCUMENTS

| | | | | |
|---|---|---|---|---|
| 6,876,933 | B2 * | 4/2005 | Yasui et al. | 702/45 |
| 7,458,361 | B2 * | 12/2008 | Wild | 123/434 |
| 2001/0013335 | A1 * | 8/2001 | Hosokawa et al. | 123/478 |
| 2002/0078924 | A1 * | 6/2002 | Yagi | 123/399 |
| 2004/0007211 | A1 * | 1/2004 | Kobayashi | 123/472 |
| 2004/0079341 | A1 * | 4/2004 | Fuwa | 123/488 |
| 2004/0107946 | A1 * | 6/2004 | Kobayashi et al. | 123/480 |
| 2004/0260482 | A1 * | 12/2004 | Tanaka et al. | 702/45 |
| 2005/0065707 | A1 * | 3/2005 | Kaga | 701/103 |
| 2006/0080024 | A1 * | 4/2006 | Abe et al. | 701/104 |
| 2006/0089780 | A1 * | 4/2006 | Muto et al. | 701/103 |
| 2008/0127938 | A1 * | 6/2008 | Hagari | 123/439 |
| 2010/0162993 | A1 * | 7/2010 | Yoshikawa et al. | 123/337 |
| 2011/0191009 | A1 * | 8/2011 | Soejima | 701/103 |

FOREIGN PATENT DOCUMENTS

| | | |
|---|---|---|
| JP | A-2008-2327 | 1/2008 |
| JP | A-2008-128082 | 6/2008 |
| JP | 2010038074 A * | 2/2010 |

* cited by examiner

CONTROL DEVICE FOR INTERNAL COMBUSTION ENGINE WHICH OPERATES A THROTTLE CORRESPONDING TO A CONTROLLED VARIABLE

TECHNICAL FIELD

The present invention relates to a control device for an internal combustion engine, and more particularly to a control device for an internal combustion engine which includes an electronically controlled throttle.

BACKGROUND ART

In the internal combustion engine which includes an electronically controlled throttle, the throttle opening is set based on the accelerator operation amount of the driver or the like, and the throttle is operated in accordance with the set throttle opening. If at this time, a delay time is set until the throttle is operated after the throttle opening is set, the actual throttle opening changes later by the delay time than the set throttle opening. Accordingly, if delay control of the throttle is performed, a future throttle opening can be estimated based on the throttle opening before delay processing by the delay time.

The delay control of the throttle is used for enhancing the control precision of an air-fuel ratio. More specifically, as described in Japanese Patent Laid-Open No. 2002-201998, the throttle opening in the closing timing of the intake valve is estimated, and the fuel injection quantity is calculated based on a cylinder inside air quantity obtained from the estimated throttle opening. The cylinder inside air quantity is fixed at the time point of closing of the intake valve, and therefore, the cylinder inside air quantity can be precisely estimated by estimating the throttle opening at the time point by delay control of the throttle.

As above, it is advantageous in the respect of the control precision of the air-fuel ratio to perform delay control of the throttle. However, delay control of the throttle intentionally delays the operation of the throttle, and therefore, if a delay time is taken to be long, responsiveness of the internal combustion engine is reduced. Therefore, from the viewpoint of the responsiveness of the internal combustion engine, the delay time is desired to be as short as possible, but it is not favorable to make the delay time simply short from the viewpoint of control precision of the air-fuel ratio. This is because in order to calculate the fuel injection quantity based on the accurate estimation of the cylinder inside air quantity, at least the time from the calculation timing of the fuel injection quantity to the closing timing of the intake valve is required as an estimation time (also called a read-ahead time).

As the control device which makes responsiveness of an internal combustion engine and control precision of the air-fuel ratio compatible in delay control of a throttle, there is, for example, a control device described in Japanese Patent Laid-Open No. 2003-120404. The control device described in Japanese Patent Laid-Open No. 2003-120404 sets the time which is required for a crankshaft to rotate 270 degrees as a delay time, and thereby, changes the delay time in accordance with the engine speed of the internal combustion engine. According to this, not only the aforementioned read-ahead time can be reliably secured as a delay time, but also the delay time is made short in a high engine speed region to obtain favorable responsiveness of the internal combustion engine.

However, in the control device described in Japanese Patent Laid-Open No. 2003-120404, the delay time depends on the engine speed, and therefore, responsiveness of the internal combustion engine in a low speed region inevitably becomes low. If favorable responsiveness of an internal combustion engine is desired to be obtained not only in a high engine speed region but also in a low engine speed region, absolute reduction in the delay time is considered to be necessary. However, the aforementioned read-ahead time changes in accordance with the engine speed, and therefore, when the delay time is made absolutely short, the situation in which the delay time becomes shorter than a required read-ahead time occurs in the low engine speed region. In order to make the responsiveness of the internal combustion engine and the control precision of the air-fuel ratio compatible in the entire operation region, it is important how precisely the cylinder inside air quantity can be estimated, when a required read-ahead time exceeds the delay time.

DISCLOSURE OF THE INVENTION

An object of the present invention is to make responsiveness of an internal combustion engine and estimation precision of a cylinder inside air quantity compatible in a control device for an internal combustion engine which estimates a future cylinder inside air quantity by delaying an operation of a throttle.

A control device according to the present invention is a control device which operates a throttle with a cylinder inside air quantity or a physical quantity correlated with the cylinder inside air quantity set as a controlled variable. The physical quantity correlated with the cylinder inside air quantity includes, for example, an intake pipe pressure. Further, a filling efficiency which is the result of making a cylinder inside air quantity dimensionless is one of such physical quantities. The control device according to the present invention sets these physical quantities as the controlled variable and operates the throttle to achieve the required value of the controlled variable.

In order to operate the throttle, the control device according to the present invention calculates an opening command value to be outputted to the throttle based on an inputted required controlled variable. On this occasion, a delay time is provided by delay means in a calculation process until the opening command value is outputted after the required controlled variable is inputted. As the calculation step in which the delay time can be provided, there exit a plurality of steps, such as the step until calculation of the opening command value is started after the required controlled variable is inputted, the step during the calculation of the opening command value, and the step until the opening command value is outputted to the throttle after the opening command value is calculated. In the present invention, a delay time may be provided in any one of these calculation steps. Further, the delay time may be a fixed value, or may be a variable which changes in accordance with the operating state of the internal combustion engine, for example, the engine speed.

Further, the control device according to the present invention estimates an actual controlled variable which is achieved at predetermined estimated timing of future, in predetermined estimation timing, and calculates a fuel injection quantity based on an estimated value of the actual controlled variable at the estimated timing. The controlled variable is a cylinder inside air quantity or the physical quantity correlated with the cylinder inside air quantity, and therefore, from the estimated value of the controlled variable, the estimated value of the actual cylinder inside air quantity at the estimated timing can be obtained. The estimated timing is preferably matched with the closing timing of the intake valve, or set in proximity of it.

One of the features of the control device according to the present invention is the estimating means of the actual controlled variable which is achieved at the estimated timing. The estimating means includes the following first estimating means and second estimating means.

The first estimating means estimates an actual controlled variable which is achieved in a time ahead from the estimation timing by the delay time, by using a calculation model defining a response characteristic of the actual controlled variable to the required controlled variable. The calculation model may be a physical model expressing the dynamic characteristic of air by a mathematical expression, but can be a simple lag element model. The lag element model may include a high-order lag element, but a first-order lag element with a smaller calculation load can be used. Further, the lag element model may be a model including a dead time.

The estimation timing is optional, and can be a time point at which the crank angle reaches a predetermined crank angle which is set at an advance side from the closing timing of the intake valve. In this case, if the estimated timing is the closing timing of the intake valve, the time up to the estimated timing from the estimation timing varies in accordance with the engine speed, and the aforesaid time becomes longer at a lower engine speed. Therefore, when the delay time is made short to make the responsiveness of the internal combustion engine favorable, the estimated timing is sometimes far ahead of the delay time. In this case, in order to enable calculation of the fuel injection quantity based on the estimated value of the actual controlled variable at the estimated timing, a change of the actual controlled variable needs to be estimated in the time ahead of the delay time.

The second estimating means is means which estimates a change amount of the actual controlled variable which occurs by the estimated timing after the time point at which the delay time elapses when a time from the estimation timing to the estimated timing exceeds the delay time. Change of the actual controlled variable up to the time point at which the delay time elapses can be estimated with high precision from the inputted required controlled variable by considering the response characteristic of the actual controlled variable to the required controlled variable. However, in regard with the change of the future actual controlled variable beyond the delay time, some assumption is required. Thus, the second estimating means assumes that when a difference exists between the estimated value and the target value of the actual controlled variable at the time point at which the delay time elapses, the actual controlled variable changes to eliminate the difference, and estimates the actual controlled variable at the estimated timing based on the assumption. The target value of the actual controlled variable at the time point at which the delay time elapses is the required controlled variable at the estimation timing.

More specifically, the second estimating means estimates the change amount of the actual controlled variable which occurs by the estimated timing from the time point at which the delay time elapses, with the actual controlled variable which is estimated by the first estimating means set as an initial value, and a required controlled variable at the estimation timing as a target value. For the estimation, a calculation model is used, which defines the response characteristic of the actual controlled variable to the required controlled variable. As the calculation model, a lag element model, in more detail, a step response model using a lag element such as the first-order lag or the second-order lag can be used. In this case, a deviation between the aforesaid target value and initial value, that is, the deviation of the required controlled variable at the estimation timing and the estimated value of the actual controlled variable at the estimated timing is the step input value.

BEST MODE FOR CARRYING OUT THE INVENTION

An embodiment of the present invention will be described with reference to each of FIGS. 1 to 5.

Figure 1:
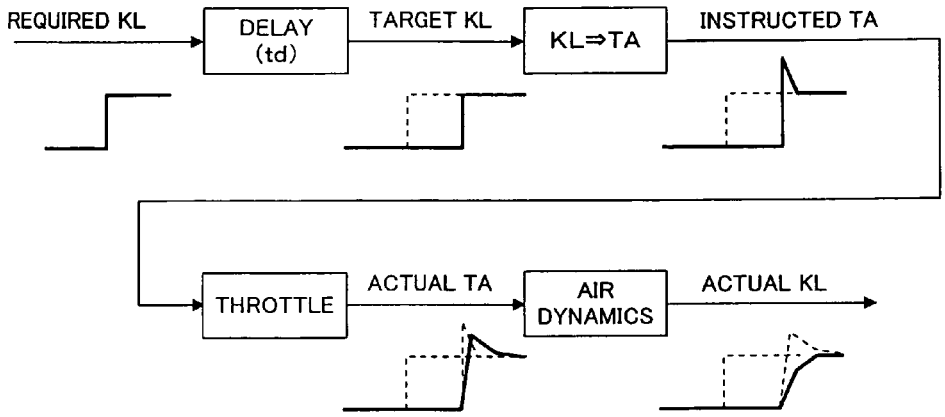
FIG. 1 is an explanatory diagram for explaining delay control of a throttle which is carried out in an embodiment of the present invention.

First, delay control of a throttle which is carried out in the present embodiment will be described by using FIG. 1. FIG. 1 shows each processing in time series, which is carried out until a change in the control variable for operating the throttle appears as a change in a cylinder inside air quantity, and also shows a signal change before and after each processing, in combination.

In the present embodiment, as the control variable for operating the throttle, the cylinder inside air filling efficiency (hereinafter, described as KL) is used. The control device acquires a required KL which is a required value of KL, and operates the throttle to achieve the required KL. FIG. 1 shows a change of each signal when the required KL increases stepwise. The required KL is calculated from torque which the internal combustion engine is required to output, for example. The throttle according to the present embodiment is of an electronically controlled type, and is driven by a throttle motor.

The control device sets what is obtained by delaying the required KL by a predetermined delay time, as a target KL. The target KL is a target value of KL which is actually achieved by the internal combustion engine. More specifically, the control device intentionally provides a time difference corresponding to the delay time, between the required KL and KL which is actually achieved by operation of the throttle. Providing such a time difference is the feature of the throttle delay control, and the provided time difference is used for estimation of future KL as will be described later. As the delay time which is the time difference is set to be longer, the estimation precision of the future KL becomes more favorable, but responsiveness of the internal combustion engine becomes lower. In the present embodiment, the delay time is fixed, and four of operation periods (for example, 8 msec) are set as the delay time.

The control device converts the target KL into a throttle opening (hereinafter, described as TA). For the conversion, for example, an inverse model of an air model can be used. An air model is a result of modeling a response of an intake air quantity to an operation of a throttle based on fluid mechanics or the like, and expressing it in a mathematical expression. By inputting the target KL in the inverse model of the air model, TA for realizing the target KL is calculated. The control device outputs TA which is thus calculated to the throttle as an instructed TA. From the signal shown in FIG. 1, it is read that the instructed TA is caused to overshoot a necessary and sufficient TA for achieving the target KL temporarily. This is the operation for promoting a quick change of KL, and by performing such an operation, a response delay of the actual KL to the change of the target KL can be compensated to a certain extent.

FIG. 1 shows a change of actual TA at the time of operating the throttle in accordance with the instructed TA, and a change of the actual KL, which is achieved by the change of the actual TA, in combination. A response delay exists in the change of the actual TA to the change of the instructed TA, and a further response delay exists in the change of the actual KL to the change of the actual TA. Accordingly, even if the instructed TA is operated in an overshooting manner, a response delay inevitably occurs between the target KL and the actual KL. The relationship of the target KL and the actual KL in this case can be expressed by using an air response model which is made by modeling the dynamic characteristic of air by a physical formula of fluid mechanics or the like. However, without using such a complicated model, the relationship can be expressed by a first-order lag+dead time model which is simpler. As will be described later, in the present embodiment, the dynamic characteristic of air is approximated by the first-order lag+dead time model, and this simple air response model is used for estimation of future KL.

The method for estimating the future KL which is carried out in the present embodiment has one feature in directly estimating the future KL from the target KL or the required KL. More specifically, the method is not adopted, which calculates the estimated value of the future KL after estimating the future throttle opening, as in the conventional method. This is for reducing the number of calculation process steps which are required for calculating the estimated value of KL from the estimated value of the throttle opening, and for enabling to reduce the estimation error of the future KL, as will be clear from the following description.

Figure 2:
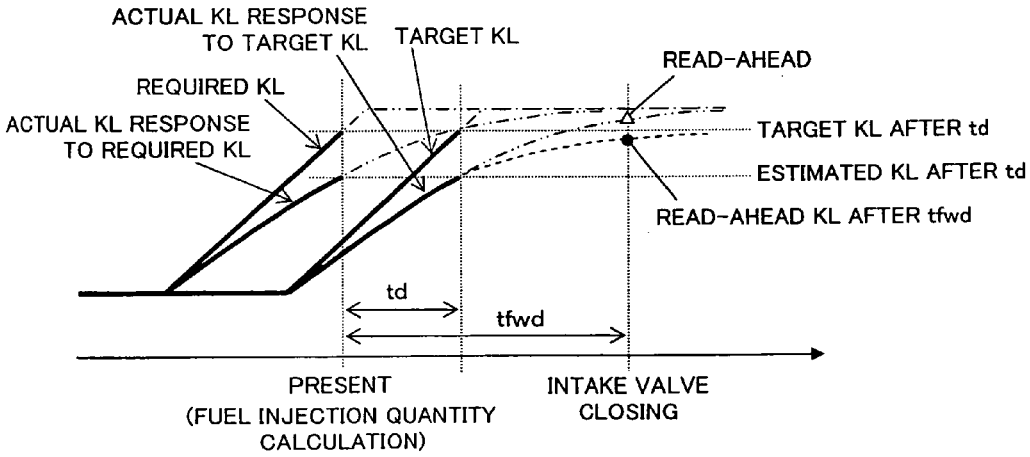
FIG. 2 is an explanatory diagram for explaining a read-ahead method of a cylinder inside air quantity which is carried out in the embodiment of the present invention.

The method for estimating the future KL which is carried out in the present embodiment can be described by using FIG. 2. FIG. 2 shows a change with time of the required KL and a change with time of the target KL in combination. As described above, the target KL is the result of delaying the required KL by a delay time (time shown by "td" in the drawing). Among the respective lines shown in FIG. 2, the thick solid line represents information which is known at the present time, and the thin two-dot chain line represents information unknown at the present time.

Further, FIG. 2 shows a change with time of the actual KL when the throttle is operated in accordance with the target KL (actual KL response to the target KL), and a change with time of the actual KL which is achieved if the throttle is operated in accordance with the required KL (actual KL response to the required KL), in combination. The actual KL response to the target KL can be calculated from the change with time of the target KL by using the aforementioned simple air response model (first-order lag+dead time model). The response of the actual KL to the required KL can be calculated from a change with time of the required KL by using the same air response model.

The present in FIG. 2 is an estimation timing, and more specifically, the calculation timing of the fuel injection quantity. Here, the fuel injection quantity is calculated at the time point when the rotational angle of the crankshaft reaches a predetermined angle. The time point at which the time represented by "tfwd" in the drawing elapses from the present is the estimated timing, and more specifically, closing timing of the intake valve. For accurate calculation of the fuel injection quantity, the cylinder inside air quantity (KL in this case) which is fixed at the closing timing of the intake valve needs to be estimated. tfwd represents the read-ahead time of KL which is required for accurate calculation of the fuel injection quantity.

FIG. 2 shows the case in which the set delay time td is shorter than the required read-ahead time tfwd. The calculation timing of the fuel injection quantity and the closing timing of the intake valve are linked with the crank angle, and therefore, the read-ahead time tfwd changes in accordance with the engine speed. Therefore, in the low engine speed region, the situation occurs, in which the delay time td becomes shorter than the required read-ahead time tfwd, as shown in FIG. 2. In this case, the known information is until after the delay time td elapses from the present, and therefore, the change of the actual KL until the read-ahead time tfwd further elapses after the delay time td elapses needs to be estimated.

In order to estimate the change of the future actual KL after the delay time td, some assumption is needed. The present embodiment is on the presumption that the value of the target KL (equal to the present value of the required KL) at the time point at which the delay time td elapses is also directly used as the target value even after the delay time td elapses, and the throttle is operated in accordance with the target value. As shown in FIG. 2, the target KL is likely to change further in reality, but the estimation is fixed to the target KL at the time point at which the delay time td elapses, and thereby, the deviation between the estimated value of the target KL and the actual value can be suppressed to the minimum on average.

According to the aforementioned assumption, if the difference is present between the estimated value and the target value of the actual KL at the time point at which the delay time td elapses, the actual KL is changed to eliminate the difference. Thus, in the present embodiment, with the estimated value of the actual KL at the time point at which the delay time td elapses (estimated KL after td) set as the initial value, and with the required KL at the present time which is estimation timing (target KL after td) set as the target value, the change amount of the actual KL which occurs until the read-ahead time tfwd elapses after the time point when the delay time td elapses is estimated. For the estimation, an air response model can be used. However, the air response model which is used here is a step response model which includes a first-order lag element and a dead time. For a time constant and a dead time thereof, those of the aforementioned first-order lag+dead time model can be used. The deviation of the target KL and the estimated KL after td is inputted stepwise into the step response model, whereby the estimated value of the change amount of the actual KL, which occurs by the time when the read-ahead time tfwd elapses from the time point at which the delay time td elapses, is calculated.

The change with time of KL which is shown by the broken line in FIG. 2 illustrates the change of the future actual KL which is estimated by the aforementioned method. As is understood from FIG. 2, the estimated value of the actual KL at the closing timing of the intake valve (read-ahead KL after tfwd) and the actual value (read-ahead target) of the actual KL are not always likely to correspond to each other. However, a change of the actual KL is estimated with the target KL at the time point at which the delay time td elapses set as the target value, and with responsiveness of air taken into consideration, as described above, and therefore, the estimated result is prevented from being deviated significantly. Further, the change of the actual KL is estimated on the precondition that the actual KL converges on the target KL at the time point at which the delay time td elapses, and therefore, the estimated value of the actual KL is prevented from overshooting.

Figure 3:
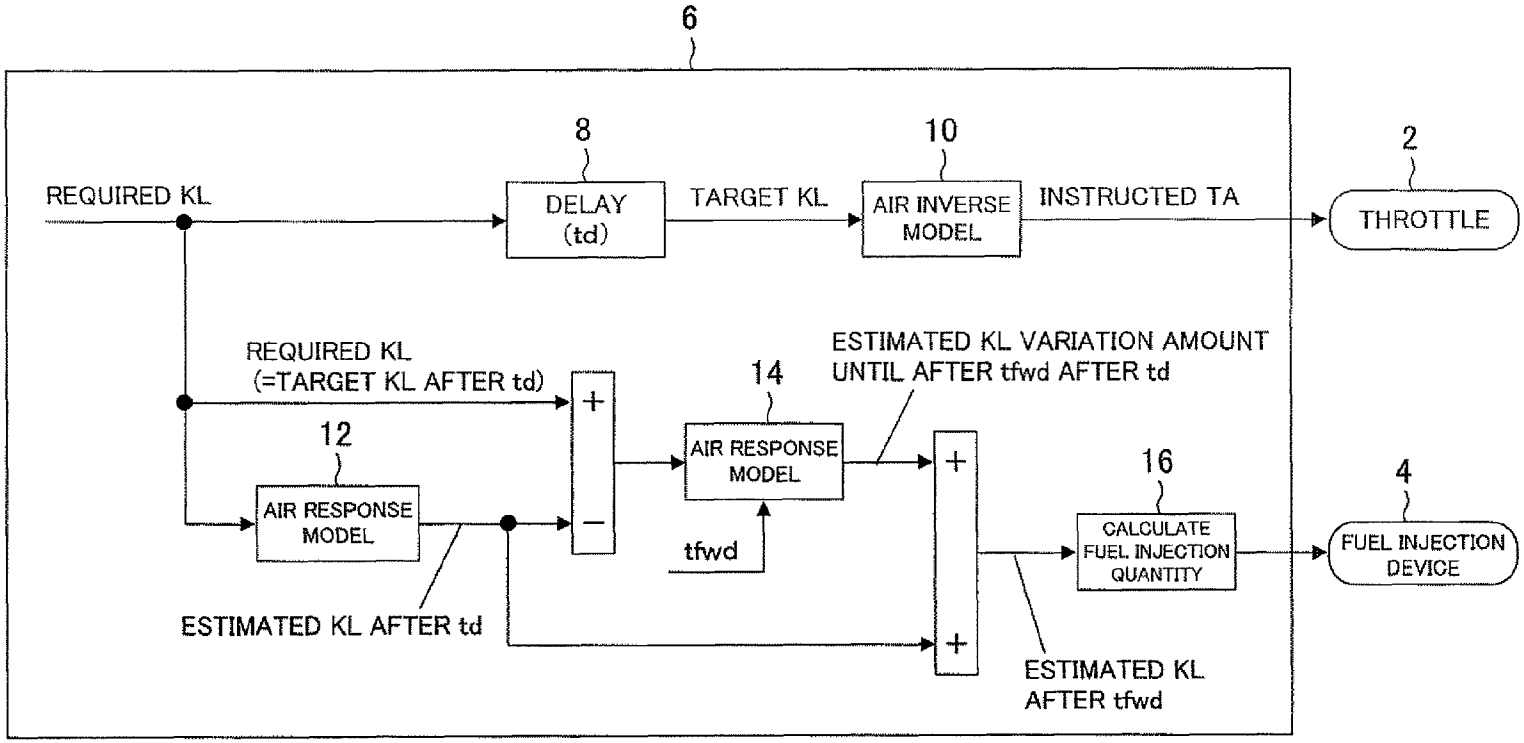
FIG. 3 is a block diagram showing a configuration of a control device of an internal combustion engine as the embodiment of the present invention.

Next, a configuration of the control device for carrying out the estimation method of the future KL as described above will be described. FIG. 3 is a block diagram showing the configuration of the control device of the present embodiment. Hereinafter, the configuration of the control device of the present embodiment will be described by using FIG. 3.

A control device 6 includes a delay circuit 8 and an air inverse model 10 as computing elements relating to the operation of a throttle 2. A signal which is obtained by subjecting the required KL to delay processing by the delay circuit 8 is the target KL. Subsequently, a signal which is obtained by converting the target KL by the air inverse model 10 is outputted to the throttle 2 as the instructed TA.

Figure 4:
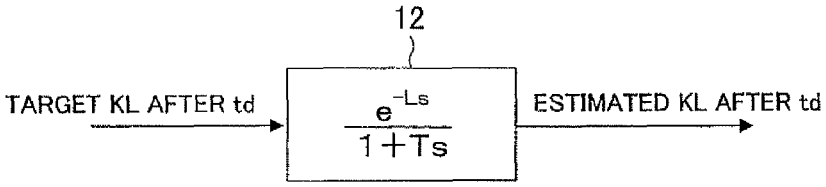
FIG. 4 is a diagram showing one example of an air response model which is used for estimation of a cylinder inside air filling efficiency KL after a lapse of a delay time (td) in the control device shown in FIG. 3.
Figure 5:
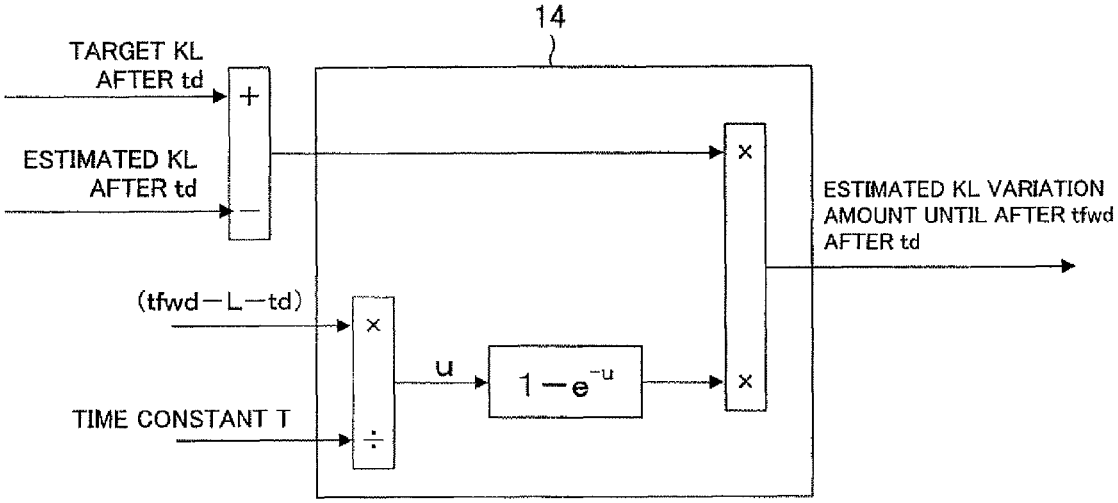
FIG. 5 is a diagram showing one example of an air response model for use in estimation of a change amount of the cylinder inside air filling efficiency KL until a read-ahead time (tfwd) elapses after the delay time (td) elapses in the control device shown in FIG. 3.

Meanwhile, as computing elements relating to the operation of a fuel injection device 4, the control device 6 includes an air response model 12, an air response model 14 and an arithmetic circuit 16. As described above, using the air response model for estimation of the future KL is one of the features of the present embodiment. FIG. 4 is a diagram showing a specific example of a configuration of the air response model 12 for use in the control device 6, and FIG. 5 is a diagram showing a specific example of a configuration of the air response model 14.

The control device 6 processes the acquired required KL according to the air response model 12, and calculates a deviation between the required KL before processing and the required KL after processing. The required KL is also the target KL at the time point at which the delay time td elapses. As shown in FIG. 4, the air response model 12 is the first-order lag+dead time model which is defined by a time constant T and a dead time L. The time constant T and the dead time L each can be determined by matching from experimental data. By processing the present required KL (namely, the target KL after td) by the air response model 12 of such a configuration, the estimated value of the actual KL at the time point at which the delay time td elapses (estimated KL after td) is calculated. Accordingly, the aforementioned deviation means the deviation between the target KL and the estimated KL after the lapse of the delay time td.

The control device 6 subsequently processes the deviation between the target KL and the estimated KL after the lapse of the delay time td according to the air response model 14, and adds the signal after processing to the estimated KL after the lapse of the delay time td. As shown in FIG. 5, the air response model 14 is a step response model, and the air response coefficient defined by "$1-e^{-u}$" is calculated, and the signal obtained by multiplying the step input value by the air response coefficient is outputted. The step input value which is used here is a deviation between the target KL and the estimated KL at the time point at which the delay time td elapses from the calculation timing of the fuel injection quantity. The value of u relating to the air response coefficient is the ratio of the estimation time (tfwd-L-td) which is obtained by correcting a required time until the time point at which the read-ahead time tfwd elapses from the time point at which the delay time td elapses by the dead time L, and the time constant T, as shown in FIG. 5. The time constant T and the dead time L can be determined by matching from the experimental data, respectively. The aforementioned deviation is processed according to the air response model 14 of such a configuration, whereby the estimated value (the estimated KL change amount until after tfwd after td) of the change amount of the actual KL which occurs until the read-ahead time tfwd elapses from the time point at which the delay time td elapses is calculated. Accordingly, the signal which is obtained by adding the signal after processing according to the air response model 14 to the estimated KL after the lapse of the delay time td means the estimated KL at the time point at which the read-ahead time tfwd elapses, that is, the estimated value of the actual KL in the closing timing of the intake valve.

The control device 6 processes an estimated future KL, that is, the estimated KL at the closing timing of the intake valve in the arithmetic circuit 16, and calculates a fuel injection quantity for realizing a desired air-fuel ratio. Subsequently, the fuel injection quantity calculated in the arithmetic circuit 16 is outputted to the fuel injection device 4 as the instructed fuel injection quantity.

As also described above, the configuration of the control device 6 shown in FIG. 3 is the configuration for realizing the estimation method of the future KL when the read-ahead time tfwd exceeds the delay time td. When the read-ahead time tfwd is shorter than the delay time td, the future KL can be estimated by using only the air response model 12. More specifically, the signal obtained by processing the required KL at the time point which is past by a difference (td-tfwd) of the delay time td and the read-ahead time tfwd with the present time (calculation timing of the fuel injection quantity) set as the reference, in accordance with the air response model 12, is the estimated value of the actual KL at the closing timing of the intake valve. Whether the read-ahead time tfwd exceeds the delay time td can be determined based on whether the engine speed is lower than a predetermined engine speed.

The embodiment of the present invention is described above, but the present invention is not limited to the aforementioned embodiment, and can be carried out by being variously modified in the range without departing from the gist of the present invention. For example, the present invention may be carried out by being modified as follows.

In the aforementioned embodiment, the throttle is operated with KL, that is, the filling efficiency of the cylinder inside air as the controlled variable, but the cylinder inside air quantity itself, or the intake pipe pressure which is a physical quantity relating to it may be used as a controlled variable.

The delay time td relating to delay processing does not have to be a constant value. For example, in accordance with the engine speed, the length of the delay time td may be changed. Further, the position of the delay circuit 8 on the signal transmission path in the control device 6 is not limited to the upstream side of the air inverse model 10. The delay circuit 8 may be located downstream of the air inverse model 10, or the delay circuit 8 may be located inside the air inverse model 10. More specifically, the delay time td can be provided in somewhere in the calculation process until the instructed TA is outputted after the required KL is inputted.

Further, in the aforementioned embodiment, the calculation timing of the fuel injection quantity which is the estimation timing is linked with the crank angle, but may be set at arbitrary timing.

Further, the air response model 12 may be a model with only the first-order lag element without a dead time taken into consideration, or may be a second-order lag model, or a second-order lag+dead time model. Furthermore, the air response model 12 may be made a model using a more precise physical formula. When packaging calculation by a function such as an exponential function is difficult in the calculation according to each of the air response models 12 and 14, calculation using a map can be adopted instead of it.

DESCRIPTION OF REFERENCE NUMERALS

6 Control device
12 Air response model
14 Air response model
td Delay time
tfwd Read-ahead time

The invention claimed is:

1. A control device for an internal combustion engine which operates a throttle corresponding to a controlled variable, wherein the controlled variable is a cylinder inside air quantity or a physical quantity correlated with the cylinder inside air quantity, the control device comprising:

an opening command value calculating means which calculates an opening command value to be outputted to the throttle based on a required controlled variable;

a delay means which provides a delay time in a calculation process until the opening command value is outputted after the required controlled variable is inputted;

an estimating means which estimates an actual controlled variable which is achieved at a predetermined estimated timing; and a fuel injection quantity calculating means which calculates a fuel injection quantity based on the estimated value of the actual controlled variable at the predetermined estimated timing by the estimating means, wherein the estimating means comprises a first estimating means which estimates the actual controlled variable which is achieved after an elapse of the delay time by using a first calculation model defining a response characteristic of the actual controlled variable to the required controlled variable, and a second estimating means which estimates a change amount of the actual controlled variable which occurs by the predetermined estimated timing after a time point at which the delay time elapses, with the actual controlled variable estimated by the first estimating means set as an initial value and the required controlled variable set as a target value, by using a second calculation model defining a response characteristic of the change amount of the actual controlled variable to the difference between the required controlled variable and the actual controlled variable estimated by the first estimation means.

2. The control device for an internal combustion engine according to claim 1, wherein the first calculation model for use in the first estimating means is a lag element model.

3. The control device for an internal combustion engine according to claim 1, wherein the second calculation model for use in the second estimating means is a lag element model.

4. The control device for an internal combustion engine according to claim 1, wherein the predetermined estimated timing is a closing timing of an intake valve.

5. The control device for an internal combustion engine according to claim 4, wherein the estimation means estimates the actual controlled variable at a time point at which a crank angle reaches a predetermined crank angle which is set before the closing timing of the intake valve, the estimating means determines whether the predetermined estimated timing occurs after the elapse of the delay time based on an engine speed, and the second estimating means estimates the change amount of the actual controlled variable where the predetermined estimated timing is determined to occur after the elapse of the delay time.

6. The control device for an internal combustion engine according to claim 1, wherein the controlled variable is a filling efficiency of cylinder inside air.

7. A control device for an internal combustion engine which operates a throttle corresponding to a controlled variable, wherein the controlled variable is a cylinder inside air quantity or a physical quantity correlated with the cylinder inside air quantity, the control device comprising:

an opening command value calculating unit which calculates an opening command value to be outputted to the throttle based on a required controlled variable;

a delay unit which provides a delay time in a calculation process until the opening command value is outputted after the required controlled variable is inputted;

an estimating unit which estimates an actual controlled variable which is achieved at a predetermined estimated timing; and a fuel injection quantity calculating unit which calculates a fuel injection quantity based on the estimated value of the actual controlled variable at the predetermined estimated timing by the estimating unit, wherein the estimating unit comprises a first estimating unit which estimates the actual controlled variable which is achieved after an elapse of the delay time by using a first calculation model defining a response characteristic of the actual controlled variable to the required controlled variable, and a second estimating unit which estimates a change amount of the actual controlled variable which occurs by the predetermined estimated timing after a time point at which the delay time elapses, with the actual controlled variable estimated by the first estimating unit set as an initial value and the required controlled variable set as a target value, by using a second calculation model defining a response characteristic of the change amount of the actual controlled variable to the difference between the required controlled variable and the actual controlled variable estimated by the first estimation unit.

* * * * *